US011781266B2

(12) United States Patent
Kim

(10) Patent No.: US 11,781,266 B2
(45) Date of Patent: Oct. 10, 2023

(54) TRANSPARENCY-ENHANCED FABRIC USING POLYESTER-ETHER BLOCK COPOLYMER YARN, AND MANUFACTURING METHOD THEREFOR

(71) Applicant: JEONGSAN INTERNATIONAL Co., Ltd., Busan (KR)

(72) Inventor: Gu Hwan Kim, Busan (KR)

(73) Assignee: JEONGSAN INTERNATIONAL CO., LTD., Busan (KR)

( * ) Notice: Subject to any disclaimer, the term of this patent is extended or adjusted under 35 U.S.C. 154(b) by 478 days.

(21) Appl. No.: 16/957,687

(22) PCT Filed: Jul. 6, 2018

(86) PCT No.: PCT/KR2018/007688
§ 371 (c)(1),
(2) Date: Jun. 24, 2020

(87) PCT Pub. No.: WO2019/240321
PCT Pub. Date: Dec. 19, 2019

(65) Prior Publication Data

US 2020/0362509 A1 Nov. 19, 2020

(30) Foreign Application Priority Data

Jun. 15, 2018 (KR) ..... 10-2018-0068593

(51) Int. Cl.

| | |
|---|---|
| ***D06P 3/00*** | (2006.01) |
| ***D06P 3/54*** | (2006.01) |
| ***D06P 3/52*** | (2006.01) |
| ***D03D 15/283*** | (2021.01) |
| *D06C 21/00* | (2006.01) |

(52) U.S. Cl.
CPC ..... *D06P 3/54* (2013.01); *D03D 15/283* (2021.01); *D06P 3/522* (2013.01); *D06C 21/00* (2013.01); *D06P 3/521* (2013.01); *D10B 2331/04* (2013.01)

(58) Field of Classification Search
CPC . D06P 3/54; D06P 3/522; D06P 3/521; D03D 15/283; D03D 15/54; D06C 21/00; D06C 3/00; D10B 2331/04; D10B 2501/043; D01D 5/16; D01D 10/02; D01F 6/86
USPC ..... 8/115.55
See application file for complete search history.

(56) References Cited

U.S. PATENT DOCUMENTS 4,467,595 A 8/1984 Kramers

FOREIGN PATENT DOCUMENTS

| | | | | |
|---|---|---|---|---|
| CN | 102168337 | A | 8/2011 | |
| EP | 1676944 | A1 | 7/2006 | |
| JP | 05295658 | A | 11/1993 | |
| JP | H0657621 | A | 3/1994 | |
| JP | H06123072 | A | 5/1994 | |
| JP | H07207551 | A | 8/1995 | |
| JP | 2000-96380 | A | 4/2000 | |
| JP | 3075192 | U | 2/2001 | |
| JP | 2005-330603 | A | 12/2005 | |
| KR | 1019950004351 | B1 | 4/1995 | |
| KR | 960010623 | B1 * | 8/1996 | ..... D04B 1/04 |
| KR | 1019960010623 | B1 | 8/1996 | |
| KR | 1019970001080 | B1 | 1/1997 | |
| KR | 101183498 | B1 | 9/2012 | |
| KR | 101448133 | B1 | 10/2014 | |

OTHER PUBLICATIONS

Office Action for Chinese Application No. 201880083871.0 [dated Feb. 3, 2021].

* cited by examiner

*Primary Examiner* — Eisa B Elhilo
(74) *Attorney, Agent, or Firm* — STETINA BRUNDA GARRED AND BRUCKER

(57) ABSTRACT

The present invention relates to a transparency-enhanced fabric using a polyester-ether block copolymer yarn, and a manufacturing method therefor and, more specifically, the method comprises the steps of: manufacturing a polyester-ether block copolymer yarn; manufacturing a textile by using the yarn; and manufacturing a transparency-enhanced fabric by thermally contracting the textile. According to a transparency-enhanced fabric using a polyester-ether block copolymer yarn and a manufacturing method therefor, of the present invention, a polyester-ether block copolymer mono-yarn is used such that the present invention has enhanced transparency allowing a see-through effect and, simultaneously, has excellent stretchability, air permeability, and wear strength.

8 Claims, No Drawings

TRANSPARENCY-ENHANCED FABRIC USING POLYESTER-ETHER BLOCK COPOLYMER YARN, AND MANUFACTURING METHOD THEREFOR

CROSS-REFERENCE TO RELATED APPLICATIONS

This application claims priority to PCT International Application No. PCT/KR2018/007688 filed on Jul. 6, 2018, which application claims priority to Korean Patent Application No. 10-2018-0068593 filed on Jun. 15, 2018, the disclosures of which are expressly incorporated herein by reference.

STATEMENT RE: FEDERALLY SPONSORED RESEARCH/DEVELOPMENT

Not Applicable

TECHNICAL FIELD

The present invention relates to a transparency-enhanced fabric using a polyester-ether block copolymer yarn and a manufacturing method thereof, and more particularly, relates to a transparency-enhanced fabric using a polyester-ether block copolymer yarn and a manufacturing method thereof showing a see-through effect and, simultaneously, having excellent stretchability, air permeability, and wear strength by using a mono-yarn of a polyester-ether block copolymer, and it can be widely used for shoe upper materials, sofas, chair skins, and the like.

BACKGROUND

As the industry has been rapidly developing and the standard of living improves and the patterns of life has been changed, various leisure activities such as leisure, hobbies, and sports are increasing, and the demand for products incorporating new materials with differentiated functions and designs in line with these trends is rapidly increasing.

These features are particularly noticeable in the case of shoe upper materials, and the demand for products with a comfortable fit, air permeability, lightweight, high strength, stretchability, differentiated functional products and fashionality of differentiated design is rapidly increasing.

Conventionally, materials mainly used as shoe upper materials can be divided into two types. There are artificial leather products using polyurethane resin coating and fabric products such as tricot, double raschel, circular knit fabrics, textiles, and the like.

As disclosed in Korean Registered Patent No. 1448133 as a prior art, artificial leather products using polyurethane are products that imitate natural leather, and have excellent wear strength, shape stability, durability, and various embossing and color expressions, and have been used a lot in the past, but there are a lot of requests for improvement because there are disadvantages such as no air permeability, heavy, no stretchability, hard sensibility, and the like.

The demand for fabric materials is increasing rapidly due to the advantages such as excellent air permeability, lightweight feeling, soft texture, various weave types and pattern expressions, various color expressions through dyeing, design expression by region, automation of shoe making by supplying piece by piece using JDQ, and the like, however, there are a lot of requests for improvement because of the disadvantages of wear strength, shape stability, contaminability, and durability degradation.

As a shoe material, there are many requests for resilience and power stretch materials that can have a stable fit in various activities, and such requests are expected to increase steadily in the future. Currently, in a way to impart stretchability, the stretchability is exhibited by using spandex yarn in combination with several percent to several tens of percent of polyester and nylon yarns when weaving, however, as it is loosely stretched in the initial stretching due to the low stretching force, the grabbing force is low therefore users feel like the shoes are twisting on their feet when a sudden force is applied, thereby necessitating a material being improved of this issue.

In addition, another design concept that is currently widely used in shoe upper materials is a product with see-through effect, which uses a material with transparency that allows the material beneath the surface to be seen, and the main materials used are polyester mono-yarn fabric products, tricot fabric products with holes, and the like.

To impart a see-through effect, polyester mono-yarn is used by weaving into textile, circular knit, tricot, and the like, but polyester mono-yarn has a hard touch feeling, and due to the problem of deterioration in flexibility and wear strength, it is limited to use in bending areas, areas receiving a lot of force, areas that require expansion and contraction, and there is a limitation in transparency since it is difficult to weave thin films due to the physical property problem. In order to improve these issues, a polyester filament yarn is woven into a hole structure to express the see-through effect through the open area of the hole, however, there is a problem in that the area on which the pattern exists cannot be revealed, and thus it is still insufficient to satisfy the needs of customers.

Therefore, considering the advantages and disadvantages of the artificial leather and fabric as described above, it is necessary to develop a fabric product with a transparency-enhanced highly densified skin surface effect that exhibits a see-through effect while having air permeability, wear strength, stretchability, and soft texture.

DETAILED DESCRIPTION OF INVENTION

Technical Problems

Therefore, an objective of the present invention is provide a transparency-enhanced fabric and a manufacturing method thereof in which the transparency showing the see-through effect is enhanced by using a mono-yarn of the polyester-ether block copolymer and, simultaneously, having excellent stretchability, air permeability, and wear strength.

Technical Solution

In order to achieve the above objective, the transparency-enhanced fabric of the present invention is characterized by heat-shrinking of a textile that is woven using polyester-ether block copolymer yarn.

In the transparency-enhanced fabric, it is characterized in that the surface of the textile is a mono-yarn of a polyester ether block copolymer, and the back surface is composed of a heterogeneous yarn of polyester, nylon or cation dyeable polyester (CDP).

In the transparency-enhanced fabric, it is characterized in that the heat-shrinking contracts the length and width by 10~30% through a hot air method using a tenter, a heating method using a thermal cylinder drum, or a shrinking method in water using a dyeing machine.

In the transparency-enhanced fabric, it is characterized in that the back surface of the textile is formed by any one printing method of gravure method, rotary method, digital printing method, and screen printing method.

In the transparency-enhanced fabric, it is characterized in that the textile which is heat-shrinked is embodied with a color by dyeing using any one of a disperse dye, an acid dye, and a basic dye.

A method of manufacturing a transparency-enhanced fabric of the present invention is characterized by comprising the steps of manufacturing a yarn of a polyester-ether block copolymer; manufacturing a textile using the yarn; and manufacturing a transparency-enhanced fabric by heat-shrinking the textile.

In the method of manufacturing the transparency-enhanced fabric, the polyester-ether block copolymer is characterized by being formed by condensation polymerization of terephthalic acid, 1,4-butanediol, and polytetramethylene glycol.

In the method of manufacturing the transparency-enhanced fabric, the step of manufacturing the textile is characterized in that after treating the yarn with a water-soluble silicone-based spinning emulsion, the spinning emulsion is removed with caustic soda.

In the method of manufacturing the transparency-enhanced fabric, the heat-shrinking is characterized in that the length and width are respectively shrunk by 10~30% through a hot air method using a tenter, a heating method using a thermal cylinder drum, or a shrinking method in water using a dyeing machine.

In the method of manufacturing the transparency-enhanced fabric, it is characterized by further comprising a step of embodying the textile, which is heat-shrinked, with a color by dyeing using any one of a disperse dye, an acid dye, and a basic dye.

Advantageous Effects of Invention

According to a transparency-enhanced fabric using the polyester-ether block copolymer yarn of the present invention and a manufacturing method thereof, the transparency which exhibits the see-through effect is enhanced by using a mono-yarn of the polyester-ether block copolymer and, simultaneously, the stretchability, air permeability, and wear strength are excellent.

DETAILED DESCRIPTION OF THE PREFERRED EMBODIMENTS

Hereinafter, exemplary embodiments disclosed herein will be described in detail with reference to the accompanying drawings, but the same or similar components are assigned the same reference numbers regardless of drawing symbols, and duplicate descriptions thereof will be omitted. The suffixes "modules" and "parts" for the components used in the following description are given or mixedly used only considering the convenience of writing the specification, and do not have meanings or roles distinguished from each other in themselves. In addition, in describing the exemplary embodiments disclosed in this specification, if it is determined that the detailed description of related well-known technologies may obscure the gist of the exemplary embodiments disclosed herein, the detailed description is omitted. In addition, the accompanying drawings are merely for easy understanding of the exemplary embodiments disclosed in the present specification, and the technical spirit disclosed in the present specification is not limited by the accompanying drawings, and it should be understood to include all modifications, equivalents, and substitutes included in the spirit and scope of the present invention.

Terms including ordinal numbers such as first and second may be used to describe various components, but the components are not limited by the terms. The terms are used only for the purpose of distinguishing one component from other components.

When a component is said to be "connected" or "attached" to other component, it is understood that the component may be directly connected to or attached to the other component, but another component may exist in the middle. On the other hand, when a component is said to be "directly connected" or "directly attached" to other component, it should be understood that no other component exists in the middle.

Singular expressions include plural expressions unless the context clearly indicates otherwise.

In the present application, the terms "comprises" or "have" are intended to assign the presence of features, numbers, steps, operations, components, parts or combinations thereof described in the specification, but it should be understood that the presence or addition possibilities of one or more other features, numbers, steps, operations, components, parts or combinations thereof are not excluded in advance.

Hereinafter, exemplary embodiments of the present invention will be described in detail. It will be apparent to those skilled in the art that the present invention may be embodied in other specific forms without departing from the spirit and essential features of the present invention.

A transparency-enhanced fabric according to the exemplary embodiment of the present invention is characterized by heat-shrinking of a textile that is woven using polyester-ether block copolymer yarn.

A polyester-ether block copolymer of the present invention is preferably manufactured by condensation polymerization of terephthalic acid, 1,4-butanediol, and polytetramethylene glycol, and comprises a hard segment made of polybutyl terephthalate and a soft segment made of polymethylene glycol, and the differences in elasticity, hardness, and physical properties occur depending on the adjustment of each ratio. When the ratio of soft segment increases, the elastic recovery force and softness increase, however, the heat resistance, strength, and the like are degraded which requires an adjustment for an appropriate ratio as necessary. The polyester-ether block copolymer mono-yarn used in the present invention preferably has a hard segment ratio of 20-60% and a soft segment ratio of 40%-80%, and the hardness is preferably Shore D 20~70, and the melt index MI is preferably to have pouring amount of 10~50 g/10 min when the piston of 190° C. is loaded with a weight of 2.16 kg, and the melting point is preferably 170~220° C.

Here, it is characterized in that the surface of the textile is a mono-yarn of a polyester ether block copolymer, and the back surface is consisted of a heterogeneous yarn of polyester, nylon or CDP.

Conventionally, a method mainly used for realizing see-through of shoe upper materials is made by weaving in the form of a circular knit, a warp knit, and a textile using a polyester mono-yarn. However, although the material using polyester mono-yarn has an excellent transparency, its touch feeling is tough and many wrinkles occur, and there are problems of tearing the fabric when bending for a long time, and as the wear strength of the surface is lowered, there are many problems in using it as an upper material. Therefore, to improve this, a polyester-ether block copolymer with elasticity and excellent transparency is being spun in the form of a mono-yarn, and it is woven into a textile, a circular knit or a warp knitted fabric and being used, so that the realization of the materials with physical properties and sensibility suitable for shoe uppers becomes possible.

In order to apply the fabric using polyester ether mono-yarn as a shoe upper material, it is necessary to manufacture the yarn to have a fineness (thickness) of 300 d or less, and as the physical properties of the yarn, a strength of 2.0 g/de or more, a stretch rate of 50~150%, and a shrinkage of 20% or less (leave for 30 minutes at 95° C.) are preferred.

In order to satisfy the properties, sensibility, and workability of the polyester-ether mono-yarn, the ratio of PBT and PTMG is required to be from 70/30 to 30/70, and adjusted appropriately according to the properties and quality level before using it.

The heat-shrinking is characterized in that the length and width are respectively shrunk to 10~30% through a hot air method using a tenter, a heating method using a thermal cylinder drum, or a shrinking method under the water using a dyeing machine.

To explain the present invention in more detail, in the present invention: a polyester-ether block copolymer is used to spin the monofilament yarn at 190~240° C. to have a fineness of 100~2000 D and being stretched to be 3~6 times long; the yarn manufactured by winding under proper tension is used to produce a dough with the required quality by using various weaving methods such as textile, circular knitting, warp knitting, and the like; it is highly densified to have an area shrinkage of 20~60% through dry heat hot air, direct heat or hot water shrinkage at 100~180° C.; in order to enhance the transparency, improve color uniformity for each lot of yarn, and improve color fastness to ultra violet (UV), dyeing is performed by adding dye and UV-enhancement agent at 100~130° C.; and, if necessary, it is manufactured by adopting various post-processing such as printing, embossing, and the like.

In order to obtain a highly densified fabric, by using the thermal shrinkage properties of polyester ether yarn, a dough whose weaving is completed is shrunk and highly densified by the hot air and hot water in the heat setting process and dyeing process, in which the area shrinkage of the fabric is 20~60%, so that a material having an excellent film surface effect, physical properties, and an excellent air permeability can be manufactured.

The back surface of the textile may be formed by any one printing method of gravure method, rotary method, digital printing method, and screen printing method.

In addition, as an exemplary embodiment of the present invention, the textile which is heat-shrinked is embodied with a color using any one dye among a disperse dye, an acid dye, and a basic dye.

Initial dyeing occurs quickly because of the low temperature thermal properties which is inherent to the material and because the distribution of the amorphous region is relatively small compared to normal polyester and the glass transition temperature Tg is low. Therefore, by dyeing with 3 combi of blue, red, and yellow dyes of E type AZO disperse dyes for pale colors whose particles are small and have good leveling properties among the disperse dye types, the clarity and levelness of color can be secured more than dyeing with S type dye, and a synergistic effect in enhancing the transparency of the material can be brought and given. Since the dyeing curve in which the actual dyeing occurs is different from that of the general polyester material, and dosing at low temperature is required for dyeing, and the light fastness is reduced when dyeing with a small molecular weight and low dye active energy, and in order to compensate for the decrease in light fastness, a light fastness material of a benzotriazole derivative is used, thereby sufficing the light fastness by comprehensively absorbing light energy in the region of 400 nm~700 nm. Considering the dye migration and adhesiveness, which are important in footwear properties, a pretreatment process is required prior to dyeing, and an appropriate dose concentration of the dye is 0.001~0.1% (O.W.F) based on 3 combi.

A method of manufacturing a transparency-enhanced fabric of the present invention is characterized by comprising the steps of: manufacturing a polyester-ether block copolymer yarn (S10); manufacturing a textile using the yarn (S20); and manufacturing a transparency-enhanced fabric by heat-shrinking the textile (S30).

Step S10 of the present invention is a step of manufacturing a polyester-ether block copolymer yarn.

The polyester-ether block copolymer is characterized by being formed by condensation polymerization of terephthalic acid, 1,4-butanediol, and polytetramethylene glycol.

The polyester-ether block copolymer of fineness of 100-2000 D is manufactured by using a mono-yarn melt spinning facility and being utilized. Detailed conditions are: spinnerets are selected and installed according to the fineness required at an extruder temperature of 190-240° C.; the discharge amount is controlled by a gear pump, and the polymer is extruded to cool in water at 25-40° C.; stretching is performed to be 3~6 times long through the primary and secondary stretching rolls; heat treatment at 150-190° C. is performed in the stabilization process; by preceding with the reduced speed ratio between the front roll and the rear roll by 10%, the elasticity is improved and the natural shrinkage ratio is minimized; if the stabilization heat treatment is insufficient, there is a possibility of uneven shrinkage after weaving textiles because of poor unwinding property due to yarn penetration problems after bobbin winding.

Thus, the yarn obtained above is treated with a spinning emulsion to enhance weaving properties and to prevent deterioration in unwinding property due to yarn penetration problem of the bobbin; the type of the emulsion is a silicone type emulsion, which is treated with a dip roll wetted with a treatment solution; it is preferable to use a water-soluble auxiliary agent as a spinning emulsion which is being used here; and if it is not completely eliminated, there is a concern that non-uniform dyeing and adhesive force problems may occur during the shoemaking process.

Since the above material has elasticity due to the nature of the material, in order to prevent deterioration in workability due to the unwinding properties when weaving, the winding work through minimizing tension is required when winding; and, in general, it is preferable to perform the winding work with a tension in the range of 40-70 g of a tension meter.

At this time, the physical properties of the yarn are preferably to have stretch rate of 70~120%, shrinkage rate of 10~15% (leave 30 minutes in water at 98° C.), and yarn strength of 2~3 g/de.

Next, step S20 of the present invention is a step of manufacturing a textile using the yarn.

Weaving the above yarn is performed with the required structure and specifications using facilities such as a weaving machine, circular knitting machine, double rashel, tricot, and the like, and weaving into various types of fabrics according to the purpose and quality of the product used. A single-layer structure material that expresses a see-through effect is manufactured by weaving machine models such as textile, circular knitting, warp knitting, and the like by using a polyester-ether single component transparent mono-yarn. It is mixed with polyester, nylon, CDP yarn, and the like, and is woven in the form of a double fabric using double-knit and double rashel models, and polyester-ether block copolymer yarn is applied on the surface in use, and general yarn is applied on the back surface and printed, and thereby it is possible to implement a material exhibiting the effect wherein various printed patterns are being projected to the surface.

For the material showing the see-through effect with a single layer, it is necessary to select the appropriate density, structure design, and yarn fineness in consideration of transparency and physical properties. If the density is high, the physical properties are good, but the transparency becomes poor. If the density is too low, the transparency is good, but there is a problem in that the skin effect is reduced due to degradation in physical properties and mesh-like feeling. Therefore, in the case of textile, preferably, the yarn fineness is 100~300 D, and the density is 60~90 ea/in in each of the warp and weft yarns; in the case of circular knit fabrics, there is a problem of less transparency than textile, but it is preferred because it has high stretchability and can utilize stretchability when combining fabrics of dissimilar materials; and the fineness of the yarn is 100~300 D, the weaving equipment is suitable for 24 gauge, diameter φ 30.

In the case of a 2-layer product, the fineness of the yarn is 100~300 D, a double knit weaving machine model is suitable for 20~24 gauge, diameter φ 30~32 considering the surface effect, stretchability, and physical properties.

The step of manufacturing a textile (S20) is characterized by removing the spinning emulsion with caustic soda after treating the yarn with a water-soluble silicone-based spinning emulsion.

Due to the surface characteristics of the yarn, it exhibits high tacky properties, and in order to improve the weaving property, a large amount of water-soluble silicone-based spinning emulsion is processed during yarn spinning, and in order to improve the occurrence of salt spots and adhesion defects caused by the spinning emulsion, the refining treatment is removed by treating with a caustic soda and a refining agent.

The yarn-applied fabric product has a light yellow color tone, and there is a color difference for each lot, so by dyeing a white fluorescent color disperse dye at 100~130° C. during dyeing, it is possible to increase the transparency due to fluorescent color development and reduce the deviation per lot.

Step S30 is a step of manufacturing the transparency-enhanced fabric by heat-shrinking the textile.

The heat-shrinking is characterized in that the length and width are respectively shrunk to 10~30% through a hot air method using a tenter, a heating method using a thermal cylinder drum, or a shrinking method in the water using a dyeing machine.

The shrinking of the polyester-ether copolymer yarn occurs during heat treatment, and stretchability also tends to be increased, and by using these characteristics, it is possible to realize a high-quality surface effect and sensibility by increasing skin surface effect and stretchability through high densification through heat-treated shrinking. As methods of densification by shrinking, there are a shrinking method by hot air of 130~190° C. using a tenter processing machine, a densification method by direct heat of 130~190° C. using a heat cylinder drum, and a high densification method through shrinking in water at 100~130° C. using rapier dyeing machine, and at this time, the shrinkage rate is about 10~30% in the length and width direction.

As an exemplary embodiment of the present invention, in a method for manufacturing the transparency-enhanced fabric, the method is characterized by further comprising a step of implementing the color of the textile, which is heat-shrinked, using any one among a disperse dye, an acid dye, and a basic dye.

According to a transparency-enhanced fabric using the polyester-ether block copolymer yarn of the present invention and a manufacturing method thereof, the transparency which exhibits the see-through effect is enhanced by using a mono-yarn of the polyester-ether block copolymer and, simultaneously, the stretchability, air permeability, and wear strength are excellent.

Hereinafter, the present invention will be described in more detail through the exemplary embodiments, but the following exemplary embodiments are for illustrative purposes only and are not intended to limit the scope of the present invention.

EXEMPLARY EMBODIMENTS

Exemplary Embodiment 1: Manufacturing of Yarn

The raw material is put into an extruder, melted at a temperature of 180° C., stretched to be 6~10 times long, with the temperature fixed, and manufactured to have the final thickness of 150 D.

The composition of the raw material is manufactured by condensation polymerization of terephthalic acid, 1,4-butanediol and polytetramethylene glycol.

It consists of a hard segment made of polybutyl terephthalate and a soft segment made of polymethylene glycol, and the elastic recovery force, softness, heat resistance, and the strength are adjusted according to the ratio of soft segments.

In the present invention, the hard segment ratio is composed of 20~60%, the soft segment ratio is composed of 40%~80%, the hardness is Shore D 20~70, melt index MI is 10~50 g/10 min, and the melting point is 170~220° C.

The polyester-ether copolymer polymer is manufactured using a mono melt spinning facility.

As a detailed condition, a spinneret capable of implementing the extruder temperature of 190~240° C. and the required fineness of 150~200 D shall be equipped.

Extrusion is performed by adjusting the discharge amount of the melted polymer with a gear pump, and cooling is performed in water at 25~40° C.

Stretching is performed to be 3 to 6 times long through the primary to secondary stretching rolls and heat treated at 150~190° C. in the stabilization process to enhance the elasticity of yarn and minimize the natural shrinkage rate. If the stabilization process is insufficient, poor unwinding property or uneven shrinking may occur after weaving due to the penetrating problems of the yarn when winding onto the bobbin The yarn obtained by the above process uses a spinning emulsion to enhance weaving properties and unwinding properties. The emulsion is a silicone type and it is treated with a dip roll wetted with a treatment solution, and the emulsion used therein is preferably water-soluble.

If the emulsion is not completely eliminated, non-uniform dyeing and adhesive force problems may occur during the shoemaking process.

In order to prevent deterioration in workability due to the unwinding properties when weaving, the winding is preferred to be performed after minimizing the tension, and a tension in the range of 40~70 g of a tension meter is appropriate.

At this time, the physical properties of the yarn are a stretch rate of 70~120%, a shrinkage rate of 10~15% (leave 30 minutes in water at 98° C.), and a yarn strength of about 2~3 g/de.

Exemplary Embodiment 2: Manufacturing of Textile

By applying the yarn of Exemplary Embodiment 1 to the warp and weft yarns, a textile applied with 100% polyester-ether mono-yarn is directly woven.

Textile is composed of warp and weft yarns, and the warping is performed in the beam of the weaving machine with about 4,000 to 5,000 warp yarns.

It should be wound up with constant tension between each yarn, and if there is a deviation in the tension of the yarn, the appearance of the fabric after weaving may be uneven or a deviation in shrinking may occur.

Weaving is performed using a rapier type weaving machine. In order to realize transparent materials such as skins with a single layer, it is necessary to have an appropriate density of the weft yarns. If the density is too high, the transparency is degraded, and if the density is too low, there is a mesh-like feeling, and thus it may give a low quality feeling.

Appropriate weft yarn density is about 50~80 yarns/in on the weaving machine.

The woven fabric is heat-shrinked in a hot water bath at 50~100° C., and a tenter processing is performed at a temperature of 120~170° C.

Dyes and auxiliary agent are added in an appropriate amount to develop color, and tenter processing is performed at a temperature of 120~170° C.

The polyester-ether copolymer mono-yarn has a characteristic that shrinking occurs during heat treatment and stretchability increases.

In order to utilize these properties, when heat treatment shrinking is performed, the material is highly densified and a skin effect is exhibited, and stretchability is increased and highly densified, thereby obtaining a luxurious surface effect and sensitivity of the material.

As for methods of densification by shrinking, there are a shrinking method by hot air of 130~190° C. using a tenter processing machine, a densification method by direct heat of 130~190° C. using a heat cylinder drum, and a high densification method through shrinking in water at 100~130° C. using rapier dyeing machine, and at this time, the shrinkage rate is about 10~30% in the length and width direction.

A large amount of water-soluble emulsion is processed to improve the unwinding properties of yarns but this spinning emulsion becomes a factor that interferes with dyeing or adhesion.

In order to improve this, the refining treatment is performed and the spinning emulsion is removed by using a refining agent such as a caustic soda and the like.

Dyeing is performed using a disperse dye and a small amount of dye so that transparency can be realized.

Dyeing is performed for 10~30 minutes at 100~130° C. in a rapier dyeing machine by adding a disperse dye.

Exemplary Embodiment 3: Post-Processing

The woven fabric is heat-shrinked in a hot water bath at 50~100° C., and a tenter processing is performed at a temperature of 120~170° C.

Dyes and auxiliary agent are added in an appropriate amount to develop color, and tenter processing is performed at a temperature of 120~170° C.

The polyester-ether copolymer mono-yarn has a characteristic that shrinking occurs during heat treatment and stretchability increases.

In order to utilize these properties, when heat treatment shrinking is performed, the material is highly densified and a skin effect is exhibited, and stretchability is increased and highly densified, thereby obtaining a luxurious surface effect and sensitivity of the material.

As for methods of densification by shrinking, there are a shrinking method by hot air of 130~190° C. using a tenter processing machine, a densification method by direct heat of 130~190° C. using a heat cylinder drum, and a high densification method through shrinking in water at 100~130° C. using rapier dyeing machine, and at this time, the shrinkage rate is about 10~30% in the length and width direction.

A large amount of water-soluble emulsion is processed to improve the unwinding properties of yarns but this spinning emulsion becomes a factor that interferes with dyeing or adhesion.

In order to improve this, the refining treatment is performed and the spinning emulsion is removed by using a refining agent such as a caustic soda and the like.

Dyeing is performed using a disperse dye and a small amount of dye so that transparency can be realized.

Dyeing is performed for 10~30 minutes at 100~130° C. in a rapier dyeing machine by adding a disperse dye.

Comparative Example

Comparative Example 1

The textile product was woven with polyester mono-yarn instead of polyester-ether mono-yarn.

Comparative Example 2

The textile product was woven with nylon mono-yarn instead of polyester-ether mono-yarn.

Referring to TABLE 1 below, when Exemplary Embodiment according to the present invention and Comparative Examples 1 and 2 are compared with each other, Exemplary Embodiment according to the present invention has a very excellent and soft texture compared to Comparative Examples 1 and 2 in terms of wear strength, stretch rate, and flexibility.

TABLE 1

| Test Items | UNIT | Exemplary Embodiment polyester-ether | Comparative Example 1 polyester | Comparative Example 2 nylon |
|---|---|---|---|---|
| Wear Strength | cycle | 50 | 30 | 30 |
| Stretch Rate | % | 100 or more | 50 or more | 50 or more |
| Flexibility | cycle | 100,000 or more | 30,000 or more | 30,000 or more |
| Touch Feeling | | Soft | Hard | Hard |

Meanwhile, the above detailed description should not be construed as limiting in all respects and should be considered as illustrative. The scope of the invention should be determined by rational interpretation of the appended claims, and all changes within the equivalent scope of the invention are included in the scope of the invention.

INDUSTRIAL APPLICABILITY

The present invention is applicable to a transparency-enhanced fabric that can be used for a shoe upper material, a sofa or a chair skin material.

What is claimed is:

1. A transparency-enhanced fabric that is a heat-shrinked textile which is woven using a polyester-ether block copolymer yarn, wherein a surface of the textile is a mono-yarn of a polyester ether block copolymer, and a back surface of the textile consists of a heterogenous yarn of polyester, nylon, or cation dyeable polyester (CDP).

2. The transparency-enhanced fabric according to claim 1, wherein a length and width of the textile are respectively shrunk by from 10 to 30% through a method selected from: a hot air method using a tenter, a heating method using a thermal cylinder drum, or a shrinking method in water using a dyeing machine.

3. The transparency-enhanced fabric according to claim 1, wherein the back surface of the textile is formed by a printing method selected from: a gravure method, a rotary method, a digital printing method, a screen printing method.

4. The transparency-enhanced fabric according to claim 1, wherein the textile which is heat-shrinked is colored by dyeing using any one of: a disperse dye, an acid dye, a basic dye.

5. A method of manufacturing a transparency-enhanced fabric comprising the steps of:

manufacturing a polyester-ether block copolymer yarn;

manufacturing a textile using the yarn; and manufacturing a transparency-enhanced fabric by heat-shrinking the textile;

wherein the polyester-ether block copolymer is formed by condensation polymerization of terephthalic acid, 1,4-butanediol, and polytetramethylene glycol.

6. The method of manufacturing a transparency-enhanced fabric according to claim 5, wherein the step of manufacturing a textile comprises removing the spinning emulsion with caustic soda after treating the yarn with a water-soluble silicone-based spinning emulsion.

7. The method of manufacturing a transparency-enhanced fabric according to claim 5, wherein the heat-shrinking step comprises a length and width of the textile being respectively shrunk by from 10 to 30% through a method selected from: a hot air method using a tenter, a heating method using a thermal cylinder drum, a shrinking method in water using a dyeing machine.

8. The method of manufacturing a transparency-enhanced fabric according to claim 5, further comprising a step of coloring of the textile which is heat-shrinked, using any one of: a disperse dye, an acid dye, a basic dye.

* * * * *